US006567994B1

(12) United States Patent
Spurr et al.

(10) Patent No.: US 6,567,994 B1
(45) Date of Patent: May 27, 2003

(54) VENTILATION OF TOILETS

(76) Inventors: John Steven Spurr, Punga Place, 462 Shallow Bay Road, Coomba Park, New South Wales, 2428 (AU); Michael Gerard Siddle, Egerton House, 46 Attunga Place, Coomba Park, New South Wales, 2428 (AU)

( * ) Notice: Subject to any disclaimer, the term of this patent is extended or adjusted under 35 U.S.C. 154(b) by 0 days.

(21) Appl. No.: 10/009,951

(22) PCT Filed: Jan. 31, 2000

(86) PCT No.: PCT/AU00/00047

§ 371 (c)(1),
(2), (4) Date: Mar. 22, 2002

(87) PCT Pub. No.: WO00/77311

PCT Pub. Date: Dec. 21, 2000

(30) Foreign Application Priority Data

Jun. 15, 1999 (AU) ..... 714333

(51) Int. Cl.[7] ..... A47K 13/30; E03D 9/04
(52) U.S. Cl. ..... 4/217; 4/352
(58) Field of Search ..... 4/213, 216, 217, 4/352

(56) References Cited

U.S. PATENT DOCUMENTS 4,125,906 A * 11/1978 Weiland ..... 4/217
4,168,553 A * 9/1979 Studer ..... 4/213 X
4,174,545 A * 11/1979 Smith ..... 4/217
6,237,163 B1 * 5/2001 Guzzo et al. ..... 4/217 X

FOREIGN PATENT DOCUMENTS

| | | |
|---|---|---|
| AU | A-37982/95 | 5/1996 |
| AU | 199935759 B3 | 12/1999 |
| EP | 692582 A1 | 7/1994 |
| GB | 2 247 255 | 2/1992 |
| GB | 2 268 520 | 1/1994 |
| GB | 2 330 152 | 4/1999 |
| GB | 2 336 604 | 10/1999 |
| WO | WO 90/14474 | 11/1990 |
| WO | WO 91/06717 | 5/1991 |
| WO | WO 98/19586 | 5/1998 |

* cited by examiner

*Primary Examiner*—Charles E. Phillips
(74) *Attorney, Agent, or Firm*—Abelman, Frayne & Schwab

(57) ABSTRACT

A ventilation system for removing odours from a toilet of the kind having a seat (10) supported on a bowl (114), the seat (10) being ducted such that there are inlet ports (22, 24, 26, 28) located at the inner rim of the seat (10) for receiving the odours and an outlet port (30) at the rear of the seat (10) for transferring the odours out of the ducting (21) in the seat (10) and into piping (18). The piping (18) is connected to an air extractors (20) and, under the suction effect of the air extractor (20), the odours are drawn away from the toilet to a circulating air environment where they can be dissipated. Each of the inlet ports (22, 24, 26, 28) have an inlet duct portion (32) which faces toward the rear of the seat (10) when the seat (10) is laid flat, and downwardly when the seat (10) is upright

4 Claims, 7 Drawing Sheets

VENTILATION OF TOILETS

FIELD OF THE INVENTION

The present invention relates to improvements in the ventilation of toilets and, in particular, to a ventilation system that utilizes a ducted toilet seat to draw undesirable odours away from the toilet.

BACKGROUND OF THE INVENTION

Commonly, the odours left behind after someone has used the toilet cause embarrassment and/or discomfort both to the user and to the person who next uses the toilet.

Toilet deodorisers and extractor fans, whether they be wall mounted or ceiling mounted, go some way to removing or at least disguising the odours. However, because they do not act to remove the odours at the source, namely in the vicinity of the toilet seat, they are sometimes only partly effective or slow in their effect, allowing some residual odours to remain by the time a person next uses the toilet. Clearly, the problem of residual odours is exacerbated the more frequently a toilet is used within any given time.

It is an object of the present invention to address the problem of odours left behind after someone has used the toilet by removing the odours nearer their source than is presently achieved with toilet deodorizers and extractor fans mounted in the perimeter of the room.

SUMMARY OF THE INVENTION

According to the invention, there is provided a ventilation system for removing odours from a toilet, said ventilation system comprising:

a seat supported on a bowl, duct means defined within the seat, the duct means having at least one inlet port for receiving the odours located at the inside rim of the toilet seat, and having at least one outlet port therefor, the duct means including an initial duct portion at the or each inlet port, the or each initial duct portion facing toward the rear of the seat when the seat is laid flat and the or each initial duct portion facing downwardly when the toilet seat is upright, an air extractor means located remotely of the seat, and a sealed pipe means connecting the or each outlet port to the air extractor means, whereby the air extractor means, when in use, draws the odours away from the toilet through the duct means in the seat.

Preferably, the duct means includes a channel which is defined between the or each initial duct portion and the or each outlet port, the cross-sectional area of space defining the or each inlet port being less than that defining the junction between the or each initial duct portion and channel.

It is preferred that the sealed pipe means is sealably connected to the or each outlet port by a coupling which is insertable into the or each outlet port, the coupling having fitted thereover a removable filter basket for trapping any particulate matter drawn through the duct means.

BRIEF DESCRIPTION OF THE DRAWINGS

In order that the invention may be readily understood and put into practical effect, reference will be made to the accompanying drawings, in which.

BEST MODE OF PERFORMING THE INVENTION

Figure 1:
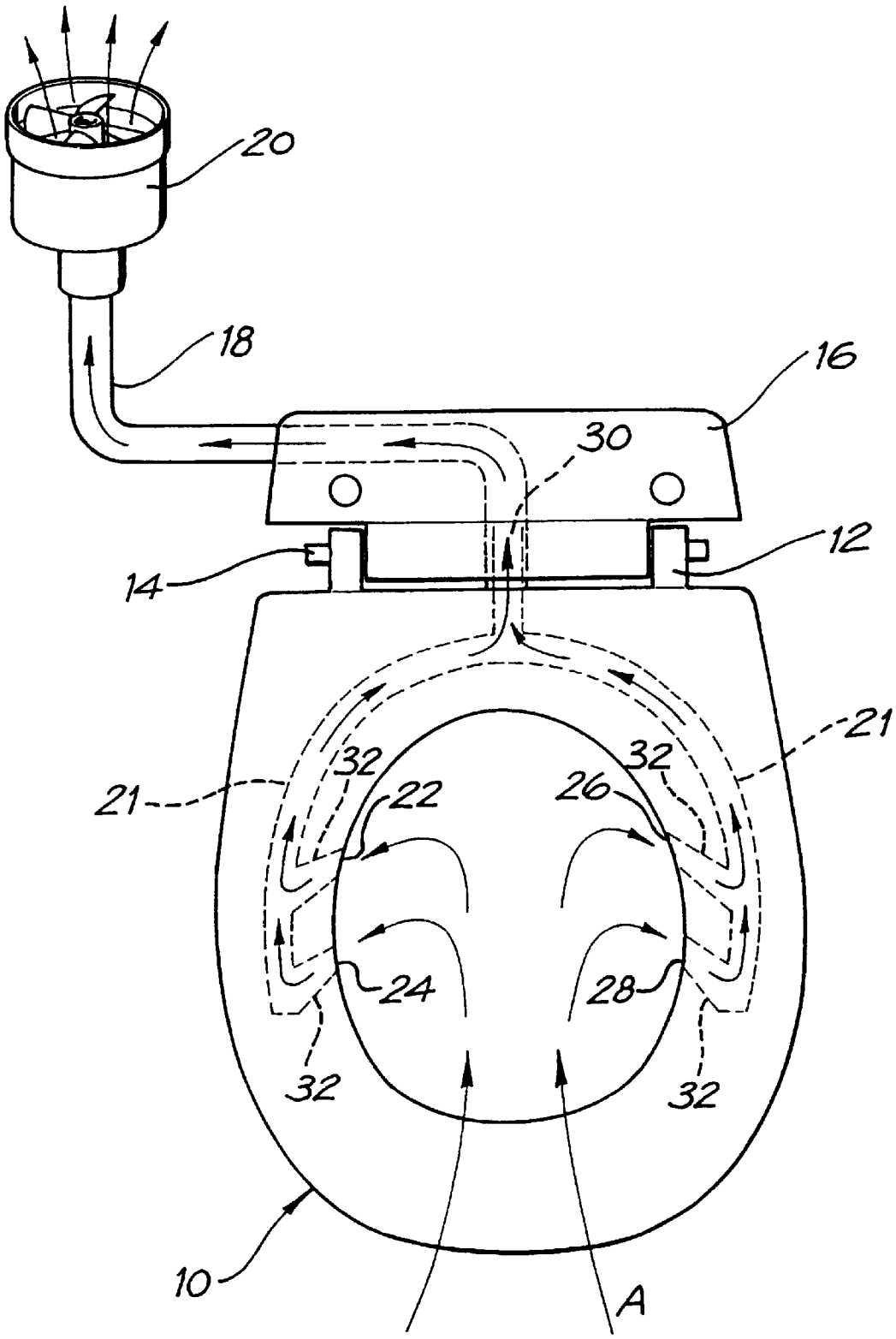
FIG. 1 is a top view of a toilet ventilation system according to a preferred embodiment of the present invention, in which the duct means in the seat are shown, and the air extractor means is adapted for room perimeter mounting.

The toilet ventilation system shown in FIG. 1 includes a seat 10, a seat hinge 12 to enable the seat 10 to pivot thereabout in customary manner, a lid hinge 14 for a lid (not shown), a hinge support assembly 16, a pipe 18 and an air extractor fan 20.

Duct means 21 are shown defined in dotted outline within the seat 10 and include four inlet ports 22, 24, 26 and 28 opening to the inside rim or inner perimeter of the seat 10 where they are most suited to receive odours from use of the toilet. The duct means 21 also include an outlet port 30 at the rear of the seat 10 through which the odours are drawn out of the duct means 21. The configuration of the duct means 21 in this embodiment is such as to prevent unwanted material, such as urine and toilet paper fragments, entering the duct means 21 through the inlet ports 22, 24, 26 and 28 both when the seat 10 is laid flat and when the seat 10 is upright. This is achieved by having the initial duct portion 32 at each inlet port 22, 24, 26 and 28 extending in the direction as shown, whereby each initial duct portion 32 faces toward the rear of the seat 10 when the seat 10 is laid flat, and faces downwardly when the seat 10 is upright.

The outlet port 30 is in sealed airflow communication with the pipe 18, which is partly housed within the hinge support assembly 16 and then extends to the air extractor fan 20. The extractor fan 20 may be replaced with a venturi blower in certain circumstances. The extractor fan 20 is mounted to an external wall or the ceiling of the room or elsewhere in the building as appropriate to ensure that the odours are released to a circulating air environment where they can be dissipated.

The arrows A indicate the air flow into and through the duct means 21 and then through the pipe 18 and extractor fan 20.

Figure 2:
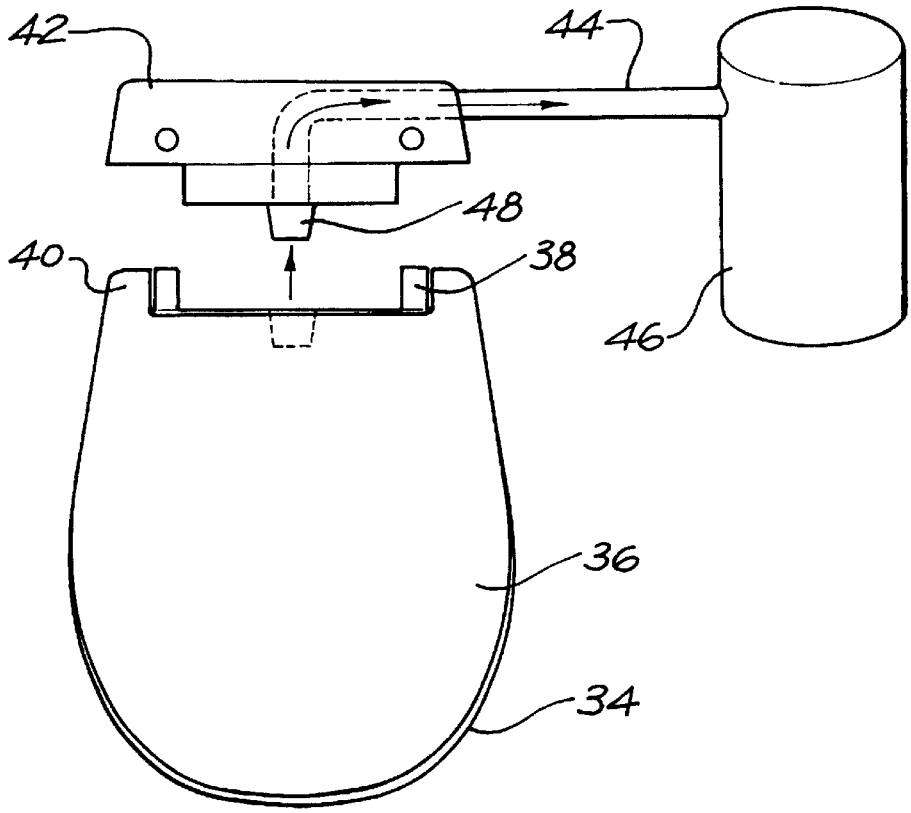
FIG. 2 is a top view of a toilet ventilation system according to another preferred embodiment of the present invention, in which the air extractor means is adapted to be free standing.

The toilet ventilation system shown in FIG. 2 includes a ducted seat 34 and a lid 36 laid flat thereon, together with a seat hinge 38, lid hinge 40, hinge support assembly 42 (shown disconnected to the seat 34), pipe 44 and a vacuum filter assembly 46 serving as a free standing air extractor means that may be located within the room. The pipe 44 is sealably connected to the outlet port of the duct means (not shown) by a coupling 48 that is insertable into the outlet port.

Figure 3:
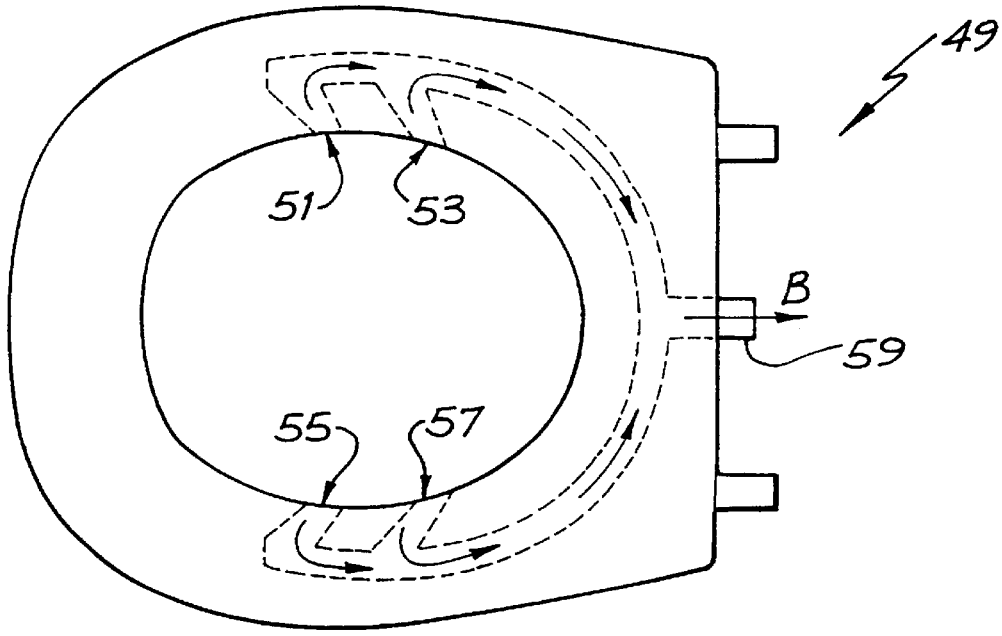
FIG. 3 is a top view of a preferred seat for use in the ventilation system of the present invention, in which the duct means and air flow therethrough are shown, FIGS. 4*a,* 4*b,* 4*c* and 4*d* are top views of four other preferred seats for use in the ventilation system of the present invention, in which the duct means for each seat are shown.
Figure 4A:
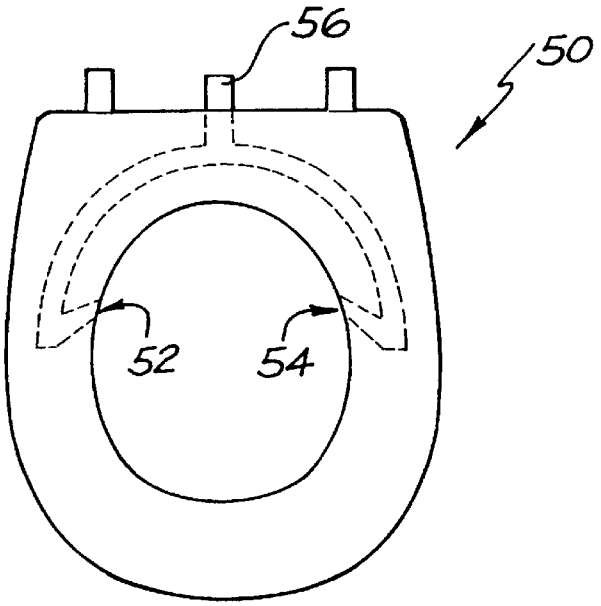
Figure 4B:
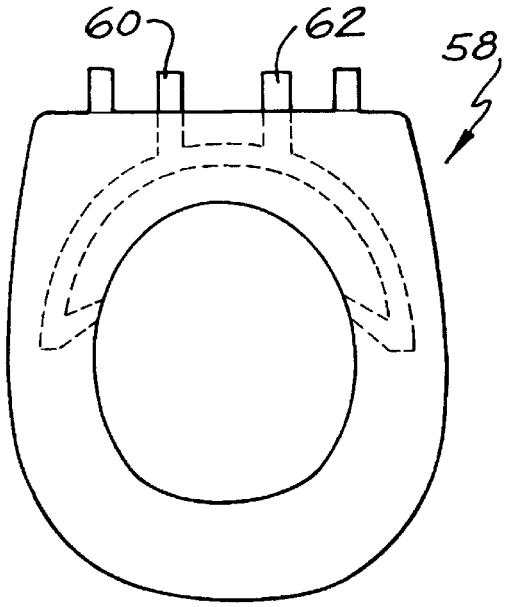
Figure 4C:
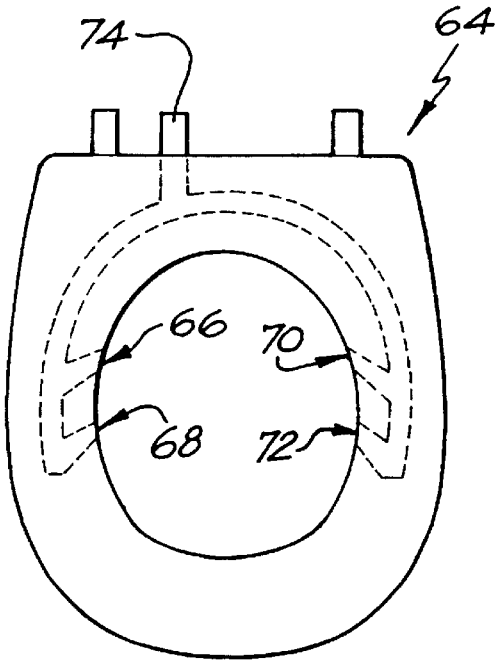
Figure 4D:
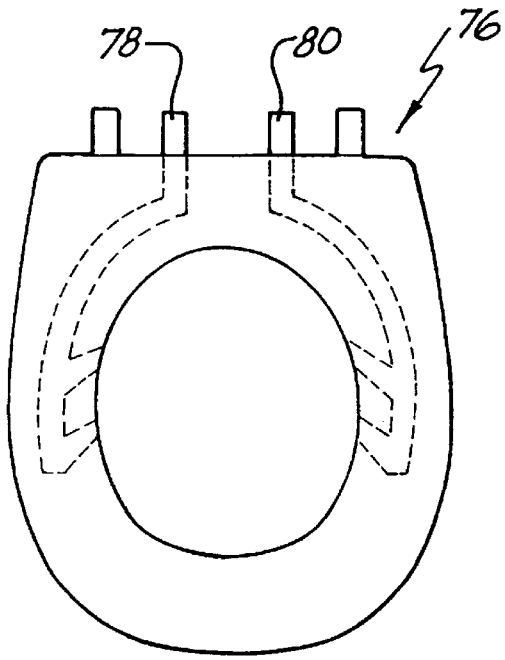

The toilet seat 49 shown in isolation in FIG. 3 has four inlet ports 51, 53, 55 and 57, two of which are opposed to the other two, and a single, centrally positioned, rear outlet port 59. The arrows B indicate the direction of air flow through the duct means (shown in dotted outline).

The alternative toilet seats shown in FIGS. 4*a* to 4*d* vary from each other predominantly in the number of inlet ports and outlet ports of their respective duct means. The toilet seat 50 of FIG. 4*a* has two opposed inlet ports 52, 54 and a single, centrally positioned, rear outlet port 56, whereas the toilet seat 58 of FIG. 4*b* only differs therefrom by having two rear outlet ports 60, 62. The toilet seat 64 of FIG. 4*c* has four inlet ports 66, 68, 70 and 72 and a single, off-centre, rear outlet port 74, whereas the toilet seat 76 of FIG. 4*d* only differs therefrom by having two rear outlet ports 78, 80 that are not in air-flow communication with each other.

Figure 5:
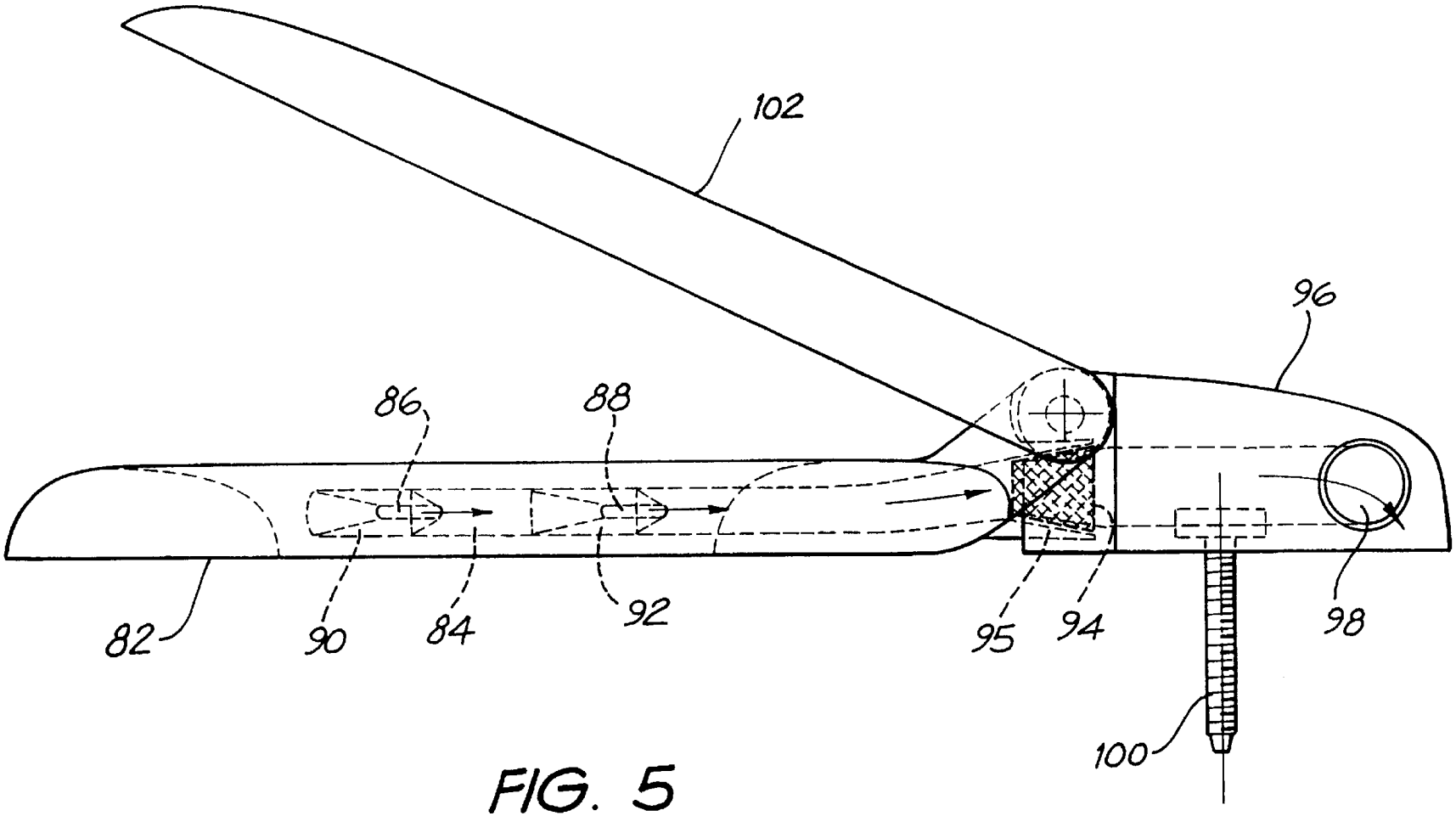
FIG. 5 is a side view of another preferred seat for use in the ventilation system of the present invention, the seat shown connected to a hinge assembly and a lid, and in which part of the duct means and part of the pipe means are shown.

The seat 82 included in FIG. 5 is similar to that shown in FIG. 3, and includes duct means in the form of a channel 84, inlet ports 86, 88 at the inner rim of the seat 82 and initial duct portions 90, 92 extending generally forwardly from each inlet port to the channel 84. The cross-sectional area of space defining each inlet port 86, 88 is significantly less than that defining the junction between each initial duct portion 90, 92 and channel 84, thereby facilitating greater suction effect at each inlet port 86, 88. There is a removable filter basket 94 over the coupling 95 where the duct means are connected to the pipe so as to trap any particulate matter, and the hinge support assembly 96 has an outlet hole 98 through which the pipe extends. A pair of bolts 100 are used to attach the seat 82, together with its lid 102 and hinge support assembly 96, to the ceramic toilet bowl.

Figure 6:
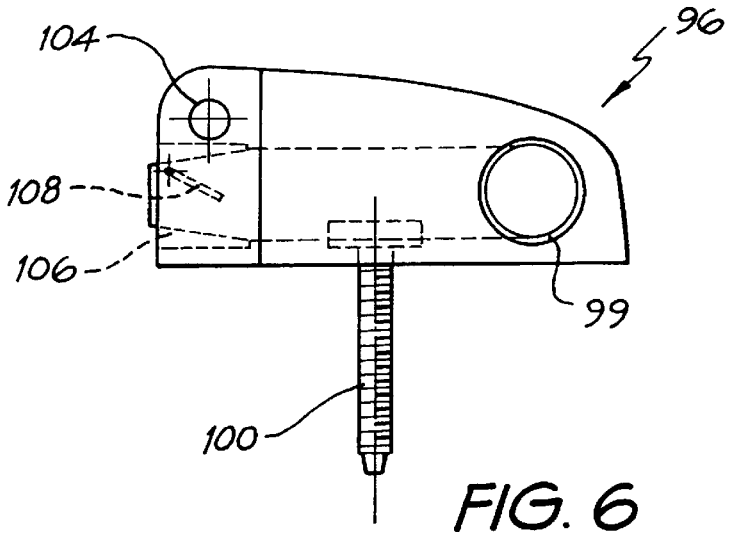
FIG. 6 is an isolated side view of the hinge assembly included in FIG. 5.
Figure 7:
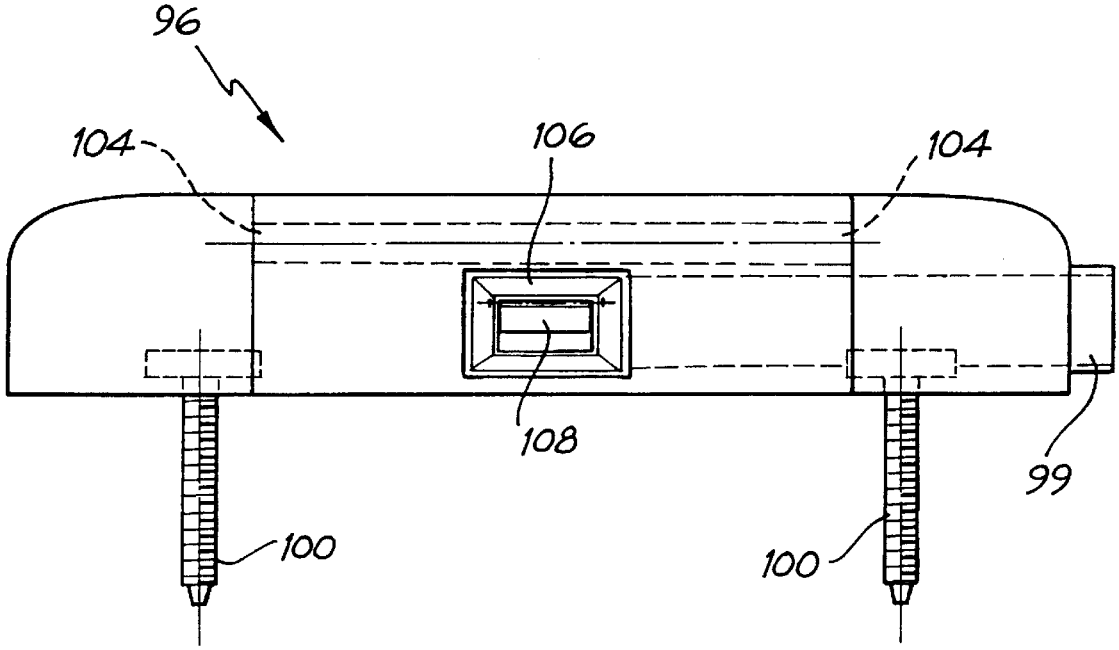
FIG. 7 is a front view of the hinge assembly of FIG. 6.

The hinge support assembly 96, shown isolated in FIGS. 6 and 7 includes a seat hinge 104, a coupling 106, and a hinged flap 108 located within the coupling 106 which closes when the seat 82 is upright to prevent ingress of unwanted matter. A pipe 99 extends from the outlet hole 98 and the two bowl attachment bolts 100 are also shown.

Figure 8:
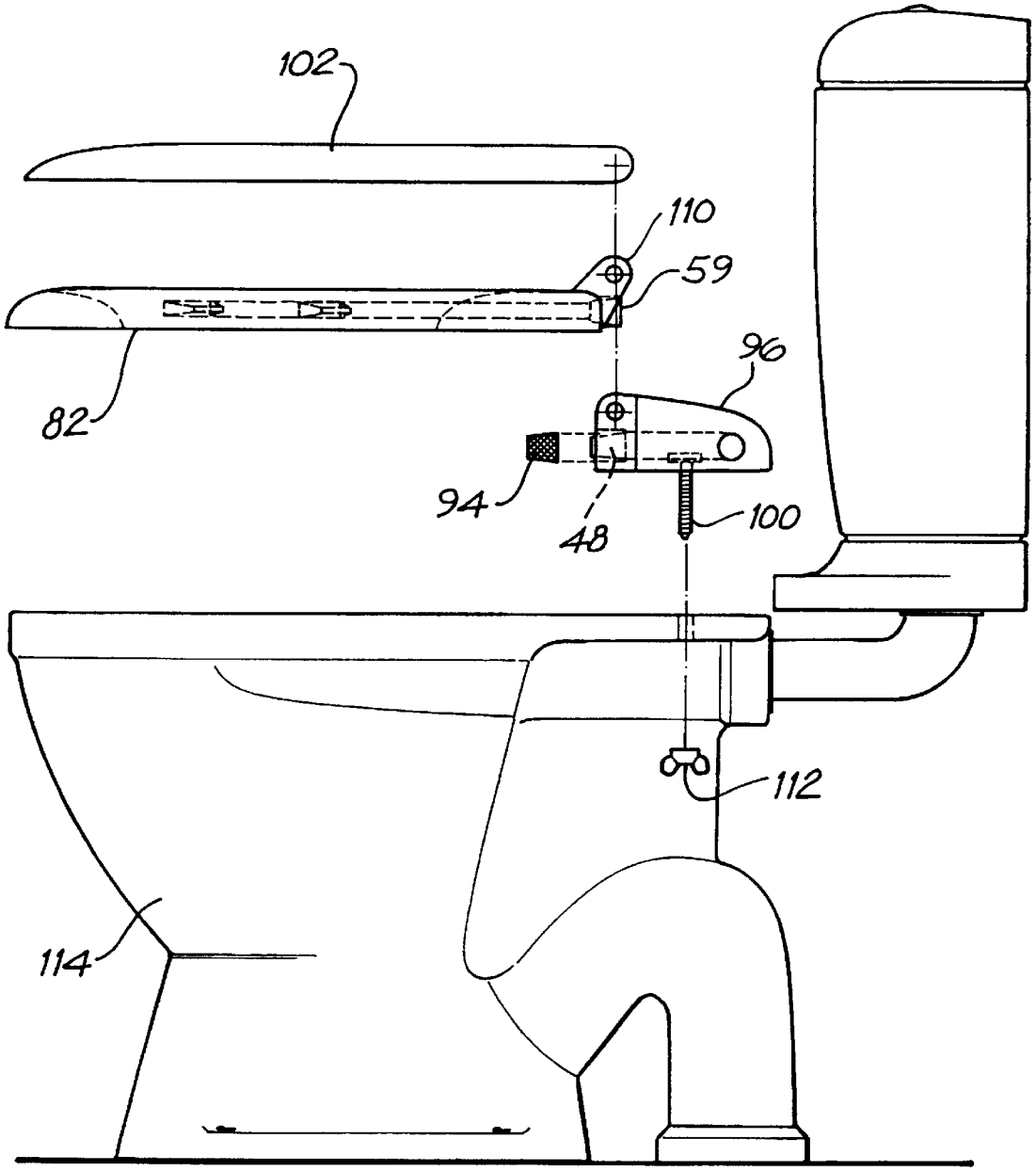
FIG. 8 is a side view of the seat, hinge assembly and lid shown in FIGS. 5 to 7, in which the seat and lid are disassembled from the hinge means, and the hinge means is partly disassembled from the toilet bowl.

FIG. 8 shows the seat 82 connected to the lid 102 by a hinge mount 110, and the hinge support assembly 96 incompletely connected via bolt 100 and wing nut 112 to the ceramic toilet bowl 114.

Figure 9:
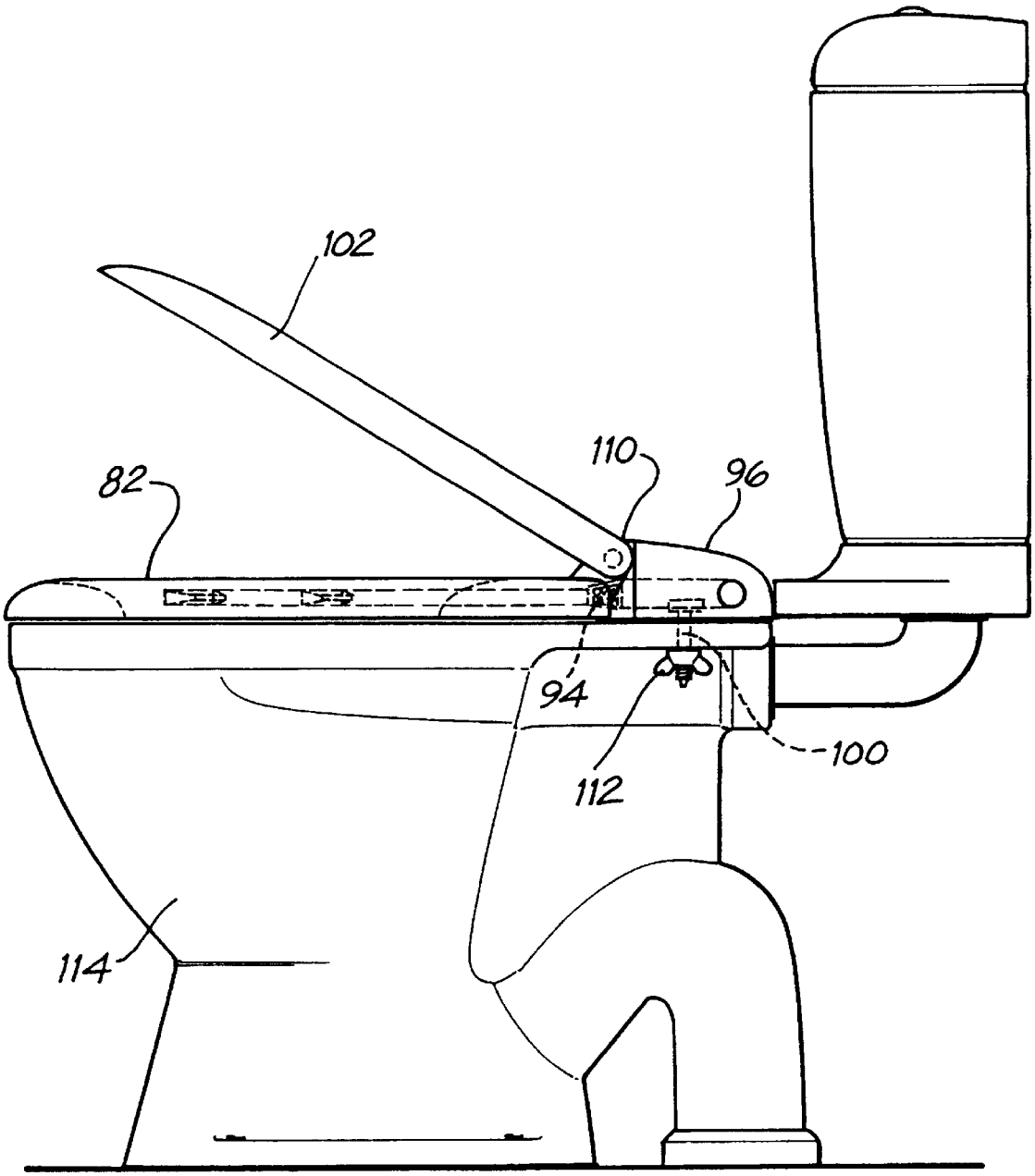
FIG. 9 is a view similar to that of FIG. 8 in which all the parts are fully assembled on the toilet bowl.

Upon connection of the seat 82 to the hinge support assembly 96 via the hinge mount 110, a secure seal is effected between the outlet port 59 (with its removable filter basket 94 located therein) and the coupler 48. Tightening the wing nuts 112 onto bolts 100 brings the seat 82 into its operational position flat on the upper rim of the toilet bowl 114, as shown in FIG. 9.

Various other modifications may be made in details of design and construction without departing from the scope or ambit of the invention.

What is claimed is:

1. A ventilation system for removing odors from a toilet, said ventilation system comprising:

a seat supported on a bowl, said seat having a front portion, a rear portion and opposing side portions, a duct defined within the seat, the duct having at least one inlet port for receiving the odors located at the inside rim along a side portion of the toilet seat, and having at least one outlet port therefor, the duct including an initial duct portion at the or each inlet port, the or each initial duct portion facing toward the rear of the seat when the seat is laid flat and the or each initial duct portion facing downwardly when the toilet seat is upright, an air extractor located remote from the seat, and a sealed pipe connecting the or each outlet port to the air extractor, whereby the air extractor, when activated, draws the odors away from the toilet through the duct in the seat.

2. The ventilation system of claim 1 wherein the duct includes a channel which is defined between the or each initial duct portion and the or each outlet port, the cross-sectional area defined by the or each inlet port being less than that defining the junction between the or each initial duct portion and channel.

3. The ventilation system of claim 2 wherein the sealed pipe is sealably connected to the or each outlet port by a coupling which is insertable into the or each outlet port, the coupling having fitted thereover a removable filter basket for trapping any particulate matter drawn through the duct.

4. The ventilation system of claim 1 wherein the sealed pipe is sealably connected to the or each outlet port by a coupling which is insertable into the or each outlet port, the coupling having fitted thereover a removable filter basket for trapping any particulate matter drawn through the duct.

* * * * *